US010890056B2

(12) United States Patent
Biddick et al.

(10) Patent No.: US 10,890,056 B2
(45) Date of Patent: Jan. 12, 2021

(54) DOWNHOLE-TYPE TOOL FOR ARTIFICIAL LIFT

(71) Applicant: Upwing Energy, LLC, Cerritos, CA (US)

(72) Inventors: David Biddick, Houston, TX (US); Patrick McMullen, Yorba Linda, CA (US)

(73) Assignee: Upwing Energy, LLC, Cerritos, CA (US)

( * ) Notice: Subject to any disclaimer, the term of this patent is extended or adjusted under 35 U.S.C. 154(b) by 90 days.

(21) Appl. No.: 16/239,267

(22) Filed: Jan. 3, 2019

(65) Prior Publication Data

US 2020/0217184 A1 Jul. 9, 2020

(51) Int. Cl.
*E21B 43/12* (2006.01)
*E21B 33/12* (2006.01)

(52) U.S. Cl.
CPC ..... *E21B 43/128* (2013.01); *E21B 33/12* (2013.01)

(58) Field of Classification Search
CPC ..... E21B 43/128; E21B 33/12
See application file for complete search history.

(56) References Cited

U.S. PATENT DOCUMENTS 5,620,048 A 4/1997 Beauquin et al.
5,988,992 A 11/1999 Tetzlaff et al.
6,167,965 B1 1/2001 Bearden et al.
6,557,642 B2 5/2003 Head
7,530,391 B2 5/2009 Hall et al.
2016/0123123 A1 5/2016 MacLean et al.
2017/0264158 A1* 9/2017 Li ..... F04B 17/03
2018/0335323 A1* 11/2018 Lu ..... E21B 33/0385

OTHER PUBLICATIONS

PCT International Search Report and Written Opinion in International Application No. PCT/US2020/012,048, dated May 12, 2020, 11 pages.

* cited by examiner

*Primary Examiner* — Kristyn A Hall
(74) *Attorney, Agent, or Firm* — Fish & Richardson P.C.

(57) ABSTRACT

An electric motor is configured to be positioned in a well. The motor includes a housing flooded with an incompressible fluid, a seal, a stator in the housing, and a rotor-impeller. The housing is configured to affix to a tubing of the well. The housing defines an inner bore having an inner bore wall continuous with an inner wall of the tubing for flow of well fluid. The housing defines a port that can be in fluid communication with the well. The seal seals the port against ingress of fluid. The seal is movable by the well fluid to apply a pressure on the incompressible fluid to equalize pressure between the incompressible fluid and the well fluid. The rotor-impeller is configured to be positioned within the inner bore of the housing. The rotor-impeller is configured to be retrievable from the well while the stator remains in the well.

19 Claims, 7 Drawing Sheets

DOWNHOLE-TYPE TOOL FOR ARTIFICIAL LIFT

TECHNICAL FIELD

This disclosure relates to downhole-type tools for artificial lift, and more specifically, downhole-type electric motors for artificial lift.

BACKGROUND

Artificial lift equipment, such as electric submersible pumps, compressors, and blowers, can be used in downhole applications to increase fluid flow within a well, thereby extending the life of the well. Such equipment, however, can fail due to a number of factors. Equipment failure can sometimes require workover procedures, which can be costly. On top of this, workover procedures can include shutting in a well in order to perform maintenance on equipment, resulting in lost production. Lost production negatively affects revenue and is therefore typically avoided when possible.

SUMMARY

Certain aspects of the subject matter described can be implemented as an electric motor configured to be positioned in a well. The electric motor includes a housing flooded with an incompressible fluid, a seal, an electric stator encased in the housing, and an electric rotor-impeller. The housing is configured to affix to a tubing of the well. The housing defines an inner bore having an inner bore wall that is continuous with an inner wall of the tubing for flow of well fluid. The housing defines on its exterior a port that, when the electric motor is positioned in the well, is in fluid communication with the well. The seal seals the port against ingress of fluid into the housing. The seal is movable by the well fluid to apply a pressure on the incompressible fluid to equalize pressure between the incompressible fluid and the well fluid. The electric rotor-impeller is configured to be positioned within the inner bore of the housing. The electric rotor-impeller is configured to be driven by the electric stator. The electric rotor-impeller is configured to be retrievable from the well while the electric stator remains in the well.

This, and other aspects, can include one or more of the following features.

The seal can include a flexible membrane.

The electric stator can include an electromagnetic coil for driving rotation of the electric rotor-impeller.

The seal can be non-metallic and form at least a portion of the inner bore wall that is continuous with the inner wall of the tubing. The seal can be configured to protect the electromagnetic from the well fluid.

The housing can include a non-metallic sleeve that forms at least a portion of the inner bore wall that is continuous with the inner wall of the tubing. The non-metallic sleeve can be configured to protect the electromagnetic coil from the well fluid.

The non-metallic sleeve can include at least one of ceramic material or carbon fiber composite.

A length of the seal along a central axis of the tubing can be longer than a length of the electric stator along the central axis of the tubing.

The seal can be disposed in a circumferential wall of the housing.

The seal can be disposed in a wall of the housing that is orthogonal to a central axis of the tubing.

Certain aspects of the subject matter can be implemented as a method. A housing affixed to a tubing is installed in a well. The housing defines an inner bore and has an inner bore wall that is continuous with an inner wall of the tubing for flow of well fluid. The housing encases an electric stator and is flooded with an incompressible fluid. The housing defines on its exterior a port that, when the housing is installed in the well, is in fluid communication with the well. The port is sealed with a seal against ingress of fluid into the housing. Pressure between the incompressible fluid within the housing and the well fluid is equalized by the seal.

This, and other aspects, can include one or more of the following features.

After installing the housing within the well, an electric rotor-impeller can be positioned within the inner bore of the housing. Power can be provided to the electric stator to drive the electric rotor-impeller.

The electric rotor-impeller can be retrieved from the well while the electric stator remains within the well.

The seal can include a flexible membrane that is movable by the well fluid to apply a pressure on the incompressible fluid within the housing to equalize pressure between the incompressible fluid and the well fluid.

The seal can be disposed in a circumferential wall of the housing.

The seal can be disposed in a wall of the housing that is orthogonal to a central axis of the tubing.

Certain aspects of the subject matter can be implemented as a method. A flow of well fluid is received at a seal disposed in a wall of a housing. The housing encases an electric stator and is flooded with an incompressible fluid. The housing is affixed to a tubing of a well. An inner, circumferential wall of the housing is continuous with an inner, circumferential wall of the tubing. The seal prevents ingress of the well fluid into the incompressible fluid within the housing. In response to receiving the flow of well fluid, pressure is transmitted through the seal to equalize pressure between the incompressible fluid and the well fluid.

This, and other aspects, can include one or more of the following features.

The seal can include a flexible membrane. The housing can include a non-metallic sleeve that forms at least a portion of the inner, circumferential wall of the housing that is continuous with the inner wall of the tubing. The electric stator can be isolated from the flow of well fluid with the non-metallic sleeve.

The seal can be disposed in the inner, circumferential wall of the housing.

The seal can be disposed in a wall of the housing that is orthogonal to a central axis of the tubing.

With the electric stator, power can be received from a remote location. An electric rotor-impeller can be driven with the electric stator in response to receiving power.

The details of one or more implementations of the subject matter of this disclosure are set forth in the accompanying drawings and the description. Other features, aspects, and advantages of the subject matter will become apparent from the description, the drawings, and the claims.

DETAILED DESCRIPTION

This disclosure describes downhole-type tools for artificial lift. Artificial lift systems installed downhole are often exposed to hostile downhole environments. Artificial lift system failures are often related to failures in the electrical system supporting the artificial lift system. In order to avoid costly workover procedures, it can be beneficial to isolate electrical portions of such artificial lift systems to portions of a well that exhibit less hostile downhole environments in comparison to the producing portions of the well. In some implementations, the electrical components of the artificial lift system are separated from rotating portions of the artificial lift system.

The subject matter described in this disclosure can be implemented in particular implementations, so as to realize one or more of the following advantages. Use of artificial lift systems described in this disclosure can increase production from wells. In some implementations, separating the electrical components of the artificial lift system from its rotating portions can improve reliability in comparison to artificial lift systems where electrical systems and electrical components are integrated with both non-rotating and rotating portions. The artificial lift systems described herein can be more reliable than artificial lift systems with electrical components integrated with both non-rotating and rotating portions, resulting in lower total capital costs over the life of a well. The improved reliability can also reduce the frequency of workover procedures, thereby reducing periods of lost production and maintenance costs. The electric motor for such artificial lift systems described here can include an electric stator encased in a housing equipped with pressure compensation, such that portions of the housing can be smaller and/or thinner in comparison to housings without pressure compensation. The smaller and/or thinner portions of the housing can allow one or more rotatable portions of the motor (such as its impellers) to occupy a larger space to provide more lift in comparison to comparable downhole-type tools that are more restricted in space (for example, electric submersible pumps without a pressure compensated housing). The electric motors described here can include an electric rotor-impeller that can be retrieved from a well, while the electric stator remains within the well. The electric rotor-impeller can undergo maintenance and be re-installed in the well, or a new electric rotor-impeller that is compatible to the electric stator within the well can be installed in the well.

Figure 1:
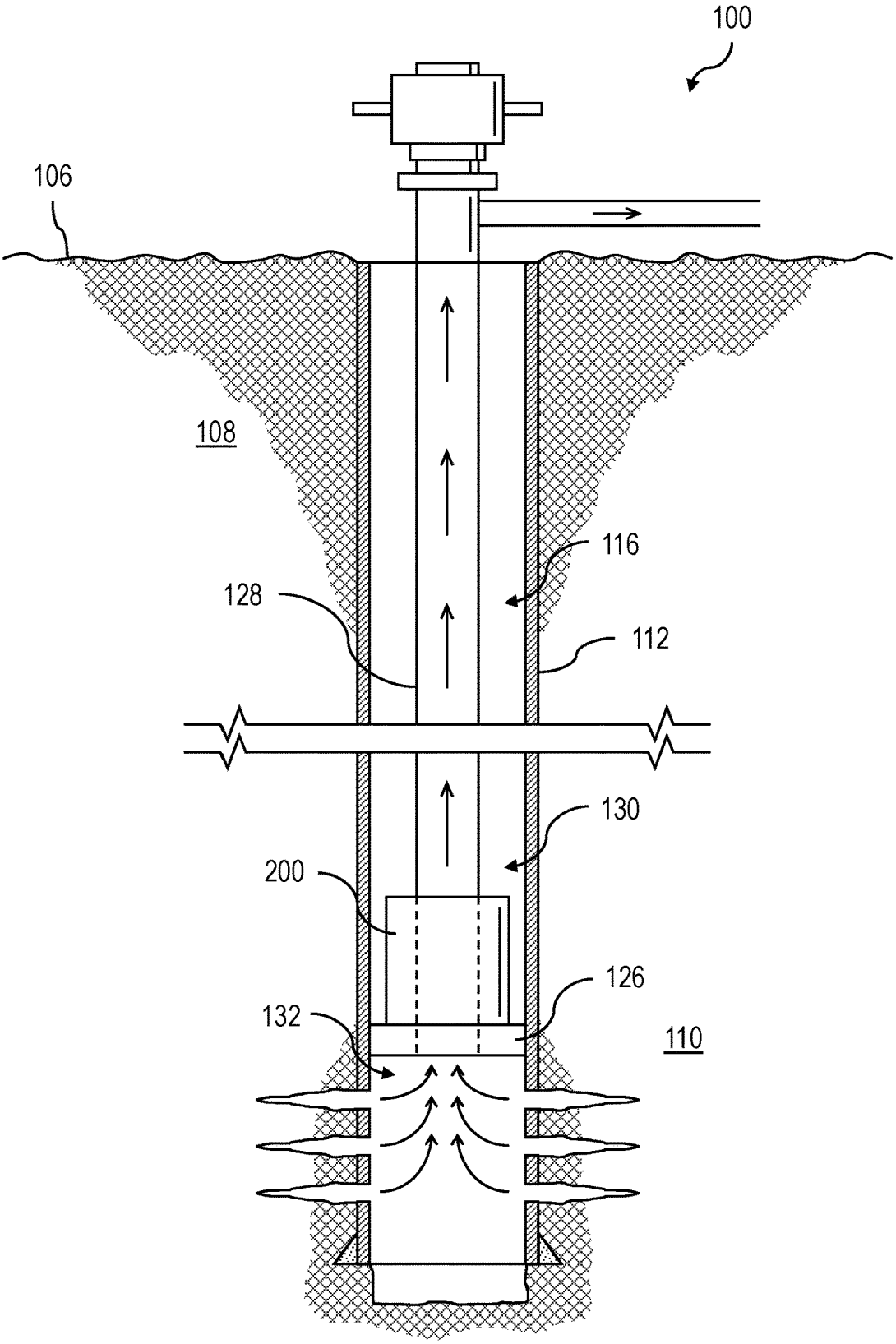
FIG. 1 is a schematic diagram of an example well.

FIG. 1 depicts an example well 100 constructed in accordance with the concepts herein. The well 100 includes a wellbore that extends from the surface 106 through the Earth 108 to one more subterranean zones of interest 110 (one shown). The well 100 enables access to the subterranean zones of interest 110 to allow recovery (that is, production) of fluids to the surface 106 (represented by flow arrows in FIG. 1) and, in some implementations, additionally or alternatively allows fluids to be placed in the Earth 108. In some implementations, the subterranean zone 110 is a formation within the Earth 108 defining a reservoir, whereas in other instances, the zone 110 can be multiple formations or a portion of a formation. The subterranean zone can include, for example, a formation, a portion of a formation, or multiple formations in a hydrocarbon-bearing reservoir from which recovery operations can be practiced to recover trapped hydrocarbons. In some implementations, the subterranean zone includes an underground formation of naturally fractured or porous rock containing hydrocarbons (for example, oil, gas, or both). In some implementations, the well can intersect other suitable types of formations, including reservoirs that are not naturally fractured in any significant amount. For simplicity's sake, the well 100 is shown as a vertical well, but in other instances, the well 100 can be a deviated well with a wellbore deviated from vertical (for example, horizontal or slanted) and/or the well 100 can include multiple bores, forming a multilateral well (that is, a well having multiple lateral wells branching off another well or wells).

In some implementations, the well 100 is a gas well that is used in producing natural gas from the subterranean zones of interest 110 to the surface 106. While termed a "gas well," the well need not produce only dry gas, and may incidentally or in much smaller quantities, produce liquid including oil and/or water. In some implementations, the well 100 is an oil well that is used in producing crude oil from the subterranean zones of interest 110 to the surface 106. While termed an "oil well,": the well not need produce only crude oil, and may incidentally or in much smaller quantities, produce gas and/or water. In some implementations, the production from the well 100 can be multiphase in any ratio, and/or can produce mostly or entirely liquid at certain times and mostly or entirely gas at other times. For example, in certain types of wells, it is common to produce water for a period of time to gain access to the gas in the subterranean zone. The concepts herein, though, are not limited in applicability to gas wells, oil wells, or even production wells, and could be used in wells for producing other gas or liquid resources, and/or could be used in injection wells, disposal wells, or other types of wells used in placing fluids into the Earth.

The wellbore of the well 100 is typically, although not necessarily, cylindrical. All or a portion of the wellbore is lined with a tubing, such as casing 112. The casing 112 connects with a wellhead at the surface 106 and extends downhole into the wellbore. The casing 112 operates to isolate the bore of the well 100, defined in the cased portion of the well 100 by the inner bore 116 of the casing 112, from the surrounding Earth 108. The casing 112 can be formed of a single continuous tubing or multiple lengths of tubing joined (for example, threadedly and/or otherwise) end-to-end of the same size or of different sizes. The casing 112 can be cemented in the wellbore, for example, by flowing cement into the annulus between the casing 112 and the wellbore wall 130. In some implementations, cement can be flowed through the inner bore of the casing 112 and directed to the outside of the casing and back up to the surface 106. In such implementations, the inner bore of the casing 112 can subsequently be cleaned of cement, while the outside of the casing 112 is cemented in place within the well 100. In some implementations, cement can be flowed through the inner bore of a tubing positioned within the casing 112. In such implementations, a seal (for example, the seal 126) can be used to seal a downhole end of the tubing to the casing 112, such that the annulus between the tubing and the casing 112 is isolated from the flow of cement. The cement can then be directed to the outside of the casing and back up to the surface 106. The inner bore of the tubing can subsequently be cleaned of cement, while the outside of the casing 112 is cemented in place within the well 100. In FIG. 1, the casing 112 is perforated in the subterranean zone of interest 110 to allow fluid communication between the subterranean zone of interest 110 and the bore 116 of the casing 112. In some implementations, the casing 112 is omitted or ceases in the region of the subterranean zone of interest 110. This portion of the well 100 without casing is often referred to as "open hole."

The wellhead defines an attachment point for other equipment to be attached to the well 100. For example, FIG. 1 shows well 100 being produced with a Christmas tree attached the wellhead. The Christmas tree includes valves used to regulate flow into or out of the well 100. The well 100 can also include an electric motor 200 residing in the wellbore, for example, at a depth that is nearer to subterranean zone 110 than the surface 106. The electric motor 200, being of a type configured in size and of robust construction for installation within a well 100, can be a part of or be used as any type of pump, compressor, or blower that can assist production of fluids to the surface 106 and out of the well 100 by creating an additional pressure differential within the well 100. Also, notably, while the concepts herein are discussed with respect to an electric submersible pump (ESP), they are likewise applicable to other types of pumps, compressors, blowers and devices for moving multi-phase fluid.

In particular, casing 112 is commercially produced in a number of common sizes specified by the American Petroleum Institute (the "API), including 4½, 5, 5½, 6, 6⅝, 7, 7⅝, 1⅝, 9⅝, 10¾, 11¾, 13⅜, 16, 11⅝ and 20 inches, and the API specifies internal diameters for each casing size. One or more portions of the electric motor 200 can be configured to fit in, and (as discussed in more detail below) in certain instances, seal to the inner diameter of one of the specified API casing sizes. Of course, one or more portions of the electric motor 200 can be made to fit in and, in certain instances, seal to other sizes of casing or tubing or otherwise seal to a wall of the well 100. As shown in FIG. 1, one or more portions of the electric motor 200 can be attached to a production tubing 128 in the well 100, and one or more portions of the electric motor 200 can be attached to the casing 112. Portions of the electric motor 200 do not need to reside within the tubing 128 and can have dimensions that are larger than the inner diameter of the tubing 128. The largest outer diameter of the electric motor 200 may therefore be larger than the inner diameter of the tubing 128. Similarly, portions of the electric motor 200 do not need to reside within the casing 112 and can have dimensions that are larger than the inner diameter of the casing 112. The largest outer diameter of the electric motor 200 may therefore be larger than the inner diameter of the casing 112.

Additionally, the construction of the components of the electric motor 200 are configured to withstand the impacts, scraping, and other physical challenges the electric motor 200 will encounter while being passed hundreds of feet/meters or even multiple miles/kilometers into and out of the well 100. For example, the electric motor 200 can be disposed in the well 100 at a depth of up to 20,000 feet (6,096 meters). Beyond just a rugged exterior, this encompasses having certain portions of any electrical components being ruggedized to be shock resistant and remain fluid tight during such physical challenges and during operation. Additionally, the electric motor 200 is configured to withstand and operate for extended periods of time (e.g., multiple weeks, months or years) at the pressures and temperatures experienced in the well 200, which temperatures can exceed 400° F./205° C. and pressures over 2,000 pounds per square inch, and while submerged in the well fluids (gas, water, or oil as examples). Finally, the electric motor 200 can be configured to interface with one or more of the common deployment systems, such as jointed tubing (that is, lengths of tubing joined end-to-end, threadedly and/or otherwise), sucker rod, coiled tubing (that is, not-jointed tubing, but rather a continuous, unbroken and flexible tubing formed as a single piece of material), slickline (that is, a single stranded wire), or wireline with an electrical conductor (that is, a monofilament or multifilament wire rope with one or more electrical conductors, sometimes called e-line) and thus have a corresponding connector (for example, a jointed tubing connector, coiled tubing connector, or wireline connector).

A seal system 126 integrated or provided separately with a downhole system, as shown with the electric motor 200, and divides the well 100 into an uphole zone 130 above the seal system 126 and a downhole zone 132 below the seal system 126. Although shown in FIG. 1 as being located downhole of the electric motor 200, the seal system 126 can optionally be located uphole of the electric motor 200. In some implementations, at least a portion of the seal system 126 can reside within the electric motor 200. FIG. 1 shows a portion of the electric motor 200 positioned in the open volume of the bore 116 of the casing 112, and connected to a production string of tubing (also referred as production tubing 128) in the well 100. The wall of the well 100 includes the interior wall of the casing 112 in portions of the wellbore having the casing 112. The well 100 can include open hole wellbore wall in uncased portions of the well 100. The seal system 126 is configured to seal against the wall of the wellbore, for example, against the interior wall of the casing 112 in the cased portions of the well 100 or against the interior wall of the wellbore in the uncased, open hole portions of the well 100. In certain instances, the seal system 126 can form a gas- and liquid-tight seal at the pressure differential the electric motor 200 creates in the well 100. For example, the seal system 126 can be configured to at least partially seal against an interior wall of the wellbore to separate (completely or substantially) a pressure in the well 100 downhole of the seal system 126 from a pressure in the well 100 uphole of the seal system 126. For example, the seal system 126 includes a production packer. Although not shown in FIG. 1, additional components, such as a surface pump, can be used in conjunction with the electric motor 200 to boost pressure in the well 100. In some implementations, the seal system 126 is not required.

In some implementations, the electric motor 200 can be implemented to alter characteristics of a wellbore by a mechanical intervention at the source. Alternatively, or in addition to any of the other implementations described in this specification, the electric motor 200 can be implemented in a direct well-casing deployment for production through the wellbore. Other implementations of the electric motor 200 can be utilized in conjunction with additional pumps, compressors, or multiphase combinations of these in the well bore to effect increased well production.

The electric motor 200 locally alters the pressure, temperature, and/or flow rate conditions of the fluid in the well 100 proximate the electric motor 200. In certain instances, the alteration performed by the electric motor 200 can optimize or help in optimizing fluid flow through the well 100. As described previously, the electric motor 200 creates a pressure differential within the well 100, for example, particularly within the locale in which the electric motor 200 resides. In some instances, a pressure at the base of the well 100 is a low pressure (for example, sub-atmospheric); so, unassisted fluid flow in the wellbore can be slow or stagnant. In these and other instances, the electric motor 200 introduced to the well 100 adjacent the perforations can reduce the pressure in the well 100 near the perforations to induce greater fluid flow from the subterranean zone 110, increase a temperature of the fluid entering the electric motor 200 to reduce condensation from limiting production, and/or increase a pressure in the well 100 uphole of the electric motor 200 to increase fluid flow to the surface 106.

The electric motor 200 moves the fluid at a first pressure downhole of the electric motor 200 to a second, higher pressure uphole of the electric motor 200. The electric motor 200 can operate at and maintain a pressure ratio across the electric motor 200 between the second, higher uphole pressure and the first, downhole pressure in the wellbore. The pressure ratio of the second pressure to the first pressure can also vary, for example, based on an operating speed of the electric motor 200. The electric motor 200 can operate at a variety of speeds, for example, where operating at higher speeds increases fluid flow, and operating at lower speeds reduces fluid flow. In some implementations, the electric motor 200 can operate at speeds up to 120,000 revolutions per minute (rpm). In some implementations, the electric motor 200 can operate at lower speeds (for example, 40,000 rpm). Specific operating speeds for the electric motor 200 can be defined based on the fluid (in relation to its composition and physical properties) and flow conditions (for example, pressure, temperature, and flow rate) for the well parameters and desired performance. Speeds can be, for example, as low as 10,000 rpm or as high as 120,000 rpm. While the electric motor 200 can be designed for an optimal speed range at which the electric motor 200 performs most efficiently, this does not prevent the electric motor 200 from running at less efficient speeds to achieve a desired flow for a particular well, as well characteristics change over time.

The electric motor 200 can operate in a variety of downhole conditions of the well 100. For example, the initial pressure within the well 100 can vary based on the type of well, depth of the well 100, production flow from the perforations into the well 100, and/or other factors. In some examples, the pressure in the well 100 proximate a bottomhole location is sub-atmospheric, where the pressure in the well 100 is at or below about 14.7 pounds per square inch absolute (psia), or about 101.3 kiloPascal (kPa). The electric motor 200 can operate in sub-atmospheric well pressures, for example, at well pressure between 2 psia (13.8 kPa) and 14.7 psia (101.3 kPa). In some examples, the pressure in the well 100 proximate a bottomhole location is much higher than atmospheric, where the pressure in the well 100 is above about 14.7 pounds per square inch absolute (psia), or about 101.3 kiloPascal (kPa). The electric motor 200 can operate in above atmospheric well pressures, for example, at well pressure between 14.7 psia (101.3 kPa) and 5,000 psia (34,474 kPa).

Figure 2A:
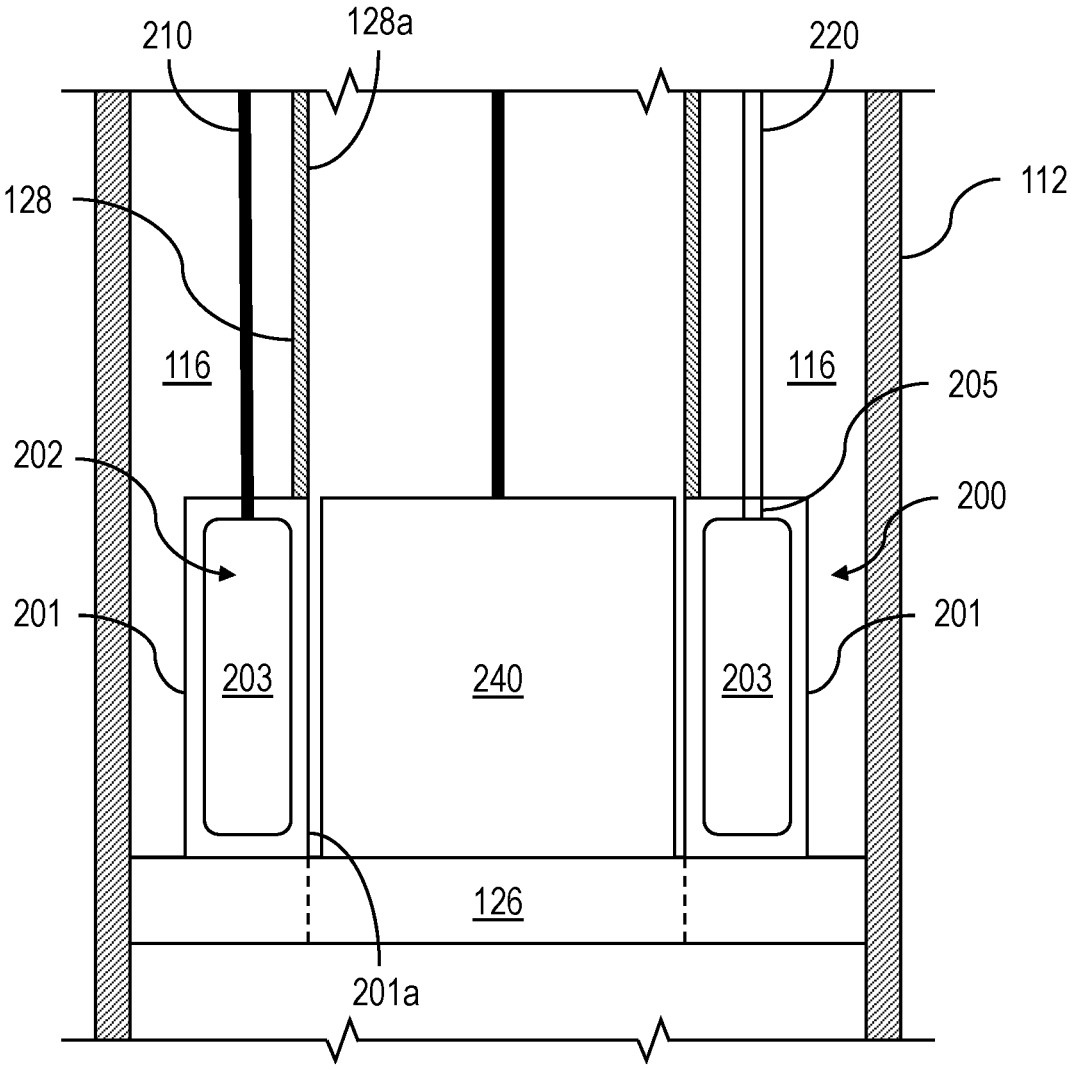
FIGS. 2A, 2B, 3A and 3B are schematic diagrams of example downhole-type tools.

Referring to FIG. 2A, the electric motor 200 is configured to be positioned in a well (such as the well 100). The electric motor 200 includes a housing 201 flooded with an incompressible fluid 202. The electric motor 200 includes an electric stator 203 encased in the housing 201. The housing 201 is configured to affix to a tubing of the well 100 (such as the production tubing 128 or the casing 112), for example, by welding, casting, or threading them together. The connection between the housing 201 and the tubing of the well 100 (such as the production tubing 128 or the casing 112) should be able to withstand tensile and compression loads (for example, from the weight of the housing 201). The housing 201 defines an inner bore and has an inner bore wall 201*a* that is continuous with an inner wall 128*a* of the tubing 128 when the housing 201 is affixed to the tubing 128. The tubing 128 and the housing 201 therefore define a continuous inner bore for the flow of well fluid. The housing 201 has mechanical strength and structural integrity that are at least equal to those of the tubing to which the housing 201 is affixed. For example, the housing 201 is able to take certain torsional loads of the casing 112. For example, the housing 201 is configured to withstand the operating conditions of the downhole environment and provide a hydraulic barrier between the inner bore and the wellbore (similar to the casing 112) or between the inner bore and the casing 112 (similar to the production tubing 128). The electric motor 200 includes an electric rotor-impeller 240 that is configured to be positioned within the inner bore 201*a* of the housing 201 and configured to be driven by the electric stator 203. The electric rotor-impeller 240 is also configured to be retrievable from the well 100 while the electric stator 203 remains in the well 100.

The inner bore wall 201*a* impacts the design and operation of the electric motor 200 in that the inner bore wall 201*a* (being continuous with the inner wall 128*a* of the tubing 128) defines part of the gap between the magnetic operating portion of the stator 203 (for example, a laminated stator winding assembly) and the magnetic operating portion of the rotor-impeller 240 (for example, a permanent magnet in the case of a permanent magnet synchronous motor). Larger clearances between such magnetic operating portions of the motor can decrease interaction of magnetic fields between the sections and can result in decreased power in comparison to motors with equivalent length and smaller such clearances. Furthermore, larger clearances can decrease motor power efficiency because more power may be required to generate magnetic fields that reach over such larger clearances. The material of the inner bore wall 201*a* can also impact the design and operation of the motor 200. Fabricating the inner bore wall 201*a* with a non-magnetic material with high electrical resistivity (such as titanium, or non-metallic materials such as ceramic, carbon fiber, or polyether ether ketone) can be preferred, in that such material can avoid hysteresis and minimize eddy current losses generated in the material due to the varying magnetic fields. While metallic materials can optionally be used to fabricate the inner bore wall 201*a*, non-magnetic materials are typically preferable for better efficiency and motor 200 performance.

In some implementations, the inner bore wall 201*a* is an inner bore wall of a protective sleeve 290 (shown in FIGS. 3A and 3B and described in more detail later). For downhole applications where the components can be subject to high pressures in a caustic environment, metallic materials are typically chosen to meet operational life requirements. The high pressure experienced by the inner bore wall 201*a* is typically due to its exposure to production fluids in the well 100. Ceramics and other non-metallic materials may be compatible with such environments but are typically limited in structural strength in comparison to metallic materials or may be sufficiently strong but may lack environmental or durability requirements. In order to use such non-metallic materials for the benefit of the operation of the motor 200, reducing the structural strength requirements of the inner bore wall 201*a* can be beneficial. By using a pressure compensator (for example, a deformable seal 209, shown in FIGS. 3A and 3B and described in more detail later), the pressure of the production fluid can be linked to a fluid within the stator 203, and the pressures can be equalized between an inner portion of the housing 201 and the outside of the housing 201. For example, in implementations where the protective sleeve 290 defines the inner bore wall 201*a*, the use of the pressure compensator can equalize the pressure on both sides of the sleeve 290, thereby eliminating the pressure differential across the sleeve 290. In such implementations, the sleeve 290 can be simply designed to be compatible with the environment characteristics without needing to be designed for increased structural strength (which often requires increased thickness). Therefore, by using the pressure compensator, the clearance between the rotor-impeller 240 and the stator 203 can be reduced (thereby increasing power efficiency of the motor 200) and non-metallic materials (such as carbon fiber and ceramics) can be used for the inner bore wall 201*a* (thereby increasing electromagnetic efficiency). Metallic materials (such as Inconel or titanium) can optionally be used while keeping in mind electromagnetic loss considerations.

In this disclosure, "incompressible fluid" should be interpreted broadly to include fluids that are nearly incompressible and retain nearly constant volume independent of pressure (for example, any liquid). The incompressible fluid 202 can, for example, be a dielectric fluid that floods the electrical components encased within the housing 201 (such as the stator 203). In some implementations, the incompressible fluid 202 is pressurized, which can reduce the differential pressure (and in some cases, equalizing the pressure) across the housing 201 between the incompressible fluid 202 and the well fluid flowing through the inner bore 201*a* of the housing 201. In some implementations, the incompressible fluid 202 can act as a lubricant. The incompressible fluid 202 can also conduct heat from stator 203 components (such as windings) to inner and outer housings (such as housing 201), to the production fluid, to a cooling fluid, or any combination of these.

The electric motor 200 can include a cable 210 connecting the stator 203 to a power source at a remote location (for example, the surface 106). At least a portion of the cable 210 can be configured to be cemented in the well 100, for example, outside of the casing 112. That portion of the cable 210 can be ruggedized and sealed against ingress of fluid and/or cement. For example, at least a portion of the cable 210 can be covered by a tubing, coating, or another type of protective layer that can prevent direct exposure of the cable 210 to an outer environment (such as the downhole environment). The protective layer can be metallic or non-metallic, as long as the protective layer is chemically compatible with the expected downhole/wellbore fluids and thermally stable in the downhole environment. For example, the cable 210 can be one or more wires that are embedded in a metal tube or contained within a metal jacket that isolates the cable 210 from cement. The cable 210 can be connected to and transmit power to multiple electrical components within the housing 201.

In some implementations, the electric motor 200 can include a cooling port 205 for connecting to a cooling tube 220. The cooling port 205 can be sealed against ingress of cement into the housing 201. A cooling tube 220 can connect the housing 201 to a coolant source at a remote location (for example, the surface 106). At least a portion of the cooling tube 220 can be configured to be cemented in the well 100, for example, outside of the casing 112. That portion of the cooling tube 220 can be ruggedized and sealed against ingress of fluid and/or cement. The coolant can be provided from the coolant source and be circulated through the housing 201 to provide cooling to the stator 203. The circulating coolant can remove heat from various components (or a heat sink) within the housing 201. Similar to the cable 210, the cooling tube 220 can be ruggedized and sealed against ingress of cement. In some implementations, the coolant floods the inner volume of the housing 201 within which the stator 203 resides. In some implementations, the coolant circulates within portions of the housing 201 where heat dissipation to the well fluid (for example flowing past the inner bore of the housing 201) is limited. The coolant circulating through the housing 201 can lower the operating temperature of the housing 201 (which can help to extend the operating life of the electric motor 200), particularly when the surrounding temperature of the environment would otherwise prevent the electric motor 200 from meeting its intended operating life.

In some implementations, the housing 201 includes a jacket through which the coolant can circulate to remove heat from the stator 203 and/or other components within the housing 201. In some implementations, the jacket is in the form of tubing or a coil positioned within the housing 201 through which the coolant can circulate to remove heat from the stator 203 and/or other components within the housing 201. In some implementations, the coolant can be isolated within the jacket and not directly interact with other components within the housing 201. In such implementations, the housing 201 is not flooded by the coolant. In some implementations, coolant does not circulate through the housing 201 (that is, coolant is not continuously supplied from the coolant source to the housing 201). Instead, one or more portions of the housing 201 are simply flooded with coolant without coolant flowing into or out of the housing 201 during operation of the downhole-type tool 200. The coolant within the housing 201 can be isolated from portion(s) of the housing 201 that are flooded by the incompressible fluid 202. In some implementations, the coolant may not be necessary, as heat from the electric motor 200 can be dissipated to its surrounding environment (for example, by the flow of well fluid, to an annulus fluid between the casing 112 and the tubing 128, or to the Earth and/or surrounding cement).

Although FIG. 2A shows both the cable 210 and the cooling tube 220 cemented in the well 100, it is not necessary that both the cable 210 and the cooling tube 220 be cemented in the well 100. For example, the cable 210 can be cemented in the well 100, while the cooling tube 220 is not cemented in the well 100. Conversely, the cooling tube 220 can be cemented in the well 100, while the cable 210 is not cemented in the well 100.

Figure 2B:
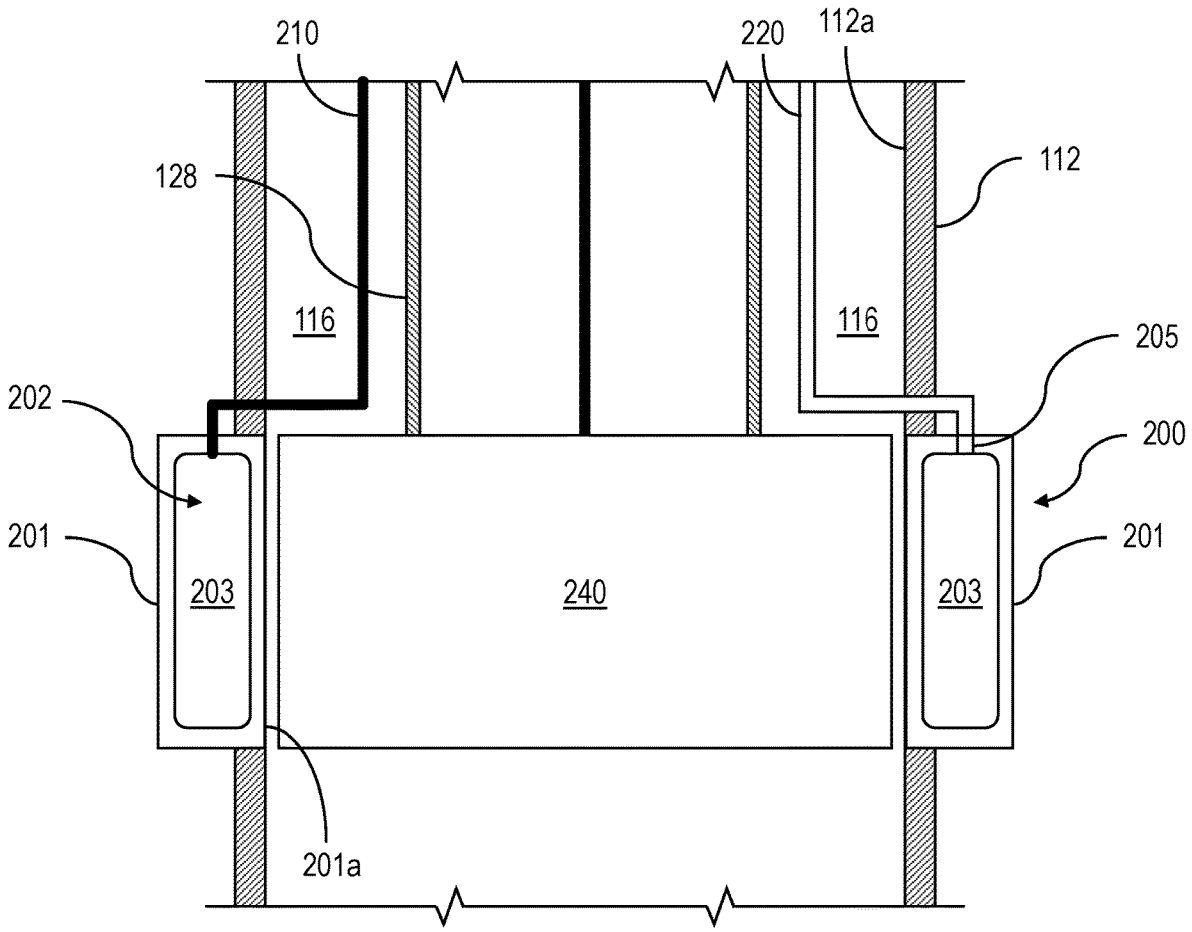

The electric motor 200 shown in FIG. 2B is substantially similar the electric motor 200 of FIG. 2A. The housing 201, however, is affixed to the casing 112, and the inner bore wall 201*a* of the housing 201 is continuous with an inner wall 112*a* of the casing 112. In such implementations, the housing 201 can be cemented in the well 100 and also be sealed against ingress of cement to the electric stator 201. As shown in FIG. 2B, the cable 210 and the cooling tube 220 can run through the annulus 116 (in contrast to being cemented in the well 100). In some implementations, the seal system 126 may not be necessary.

Although FIG. 2B shows both the cable 210 and the cooling tube 220 running through the annulus 116, it is not necessary that both the cable 210 and the cooling tube 220 run through the annulus 116. For example, the cable 210 can run through the annulus 116, while the cooling tube 220 does not. Conversely, the cooling tube 220 can run through the annulus 116, while the cable 220 does not.

Although the housing 201 and the electric rotor-impeller 240 are shown in FIGS. 2A and 2B as having the same length along the central axis of the tubing 128, the housing 201 and the electric rotor-impeller 240 can have the same length or different lengths along the central axis of the tubing 128. For example, the housing 201 can have a shorter length in comparison to the electric rotor-impeller 240 along the central axis of the tubing 128. Alternatively, the housing 201 can have a longer length in comparison to the electric rotor-impeller 240 along the central axis of the tubing 128.

Figure 3A:
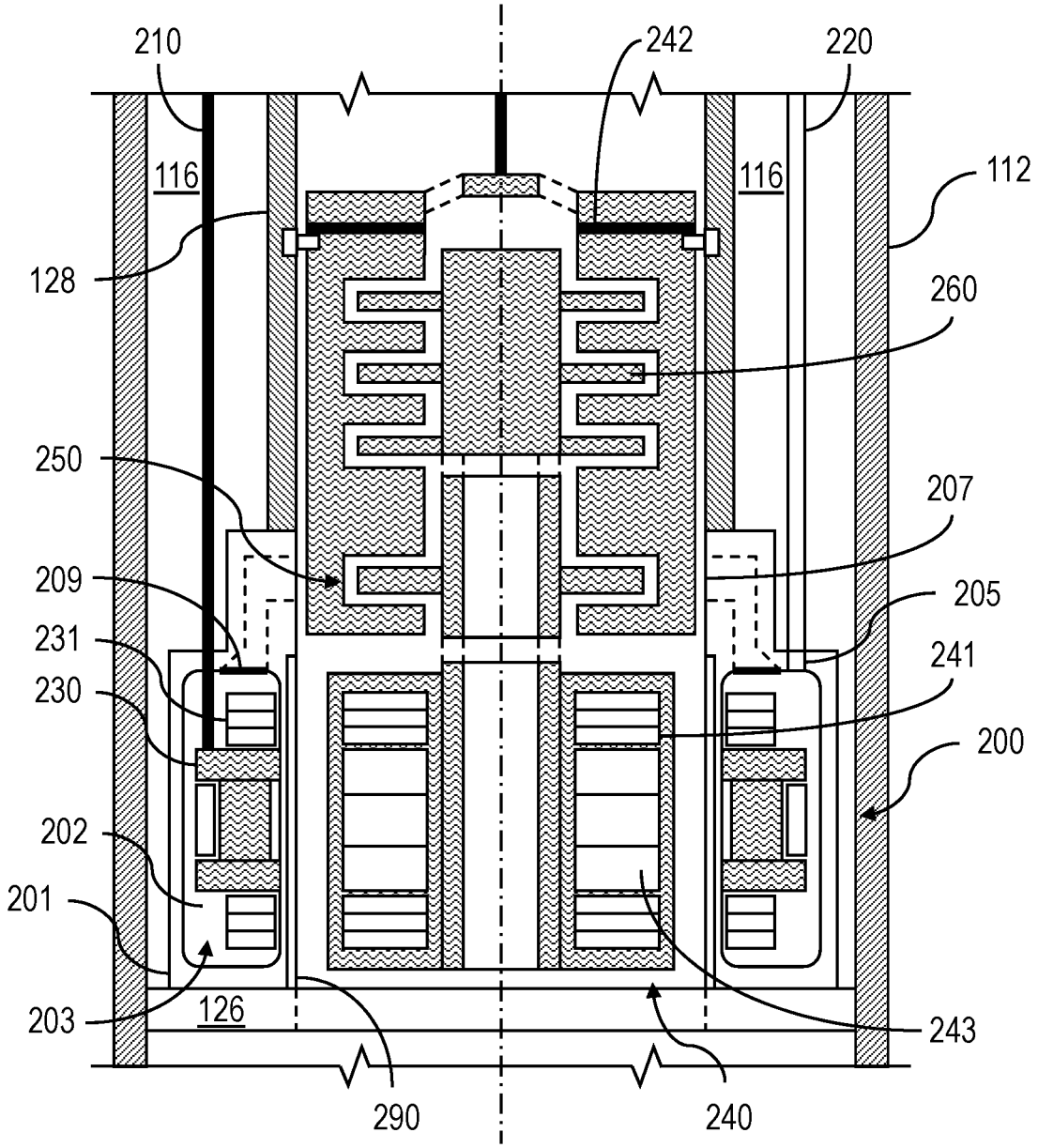

FIG. 3A illustrates an example electric motor 200. The stator 203 encased within the housing 201 can include a magnetic field source 230, such as an electromagnetic coil. The electromagnetic coil 230 can be connected to the cable 210, and in response to receiving power, the electromagnetic coil 230 can generate a magnetic field to drive the electric rotor-impeller 240. The electric rotor-impeller 240 can include one or more permanent magnets 243. The electromagnetic coil 230 and the permanent magnet 243 can interact magnetically. The electromagnetic coil 230 and the permanent magnet 243 can each generate magnetic fields which attract or repel each other. The attraction or repulsion can impart forces that cause the rotor-impeller 240 to rotate.

The electric rotor-impeller 240 can include a rotating portion and a non-rotating portion. The rotating portion of the electric rotor-impeller 240 can include a central rotating shaft and one or more impellers 260 coupled to the central rotating shaft. The non-rotating portion of the electric rotor-impeller 240 can include a diffuser and can, for example, be attached to the production tubing 128. The non-rotating portion of the electric rotor-impeller 240 can include a recirculation isolator 242 that is configured to create a seal between the non-rotating portion of the electric rotor-impeller 240 and the production tubing 128 (or the casing 112). The recirculation isolator 242 can couple to the production tubing 128 (or the casing 112) and prevent rotation of the non-rotating portion of the rotor-impeller 240 while the rotating portion of the rotor-impeller 240 rotates. In implementations where the recirculation isolator 242 forms a seal between the non-rotating portion of the electric rotor-impeller 240 and the casing 112, the seal system 126 may not be necessary. In some implementations, the recirculation isolator 242 includes an anchor with mechanical slips that can stab into an inner wall of the well 100 (such as the production tubing 128 or the casing 112). In some implementations, the rotor-impeller 240 is free of electrical components.

As shown in FIG. 3A, one or more portions of the rotor-impeller 240 can be hollow, so that well fluid can flow through such portions of the rotor-impeller 240. For example, well fluid can flow past an outer, circumferential surface of the rotor-impeller 240, and the rotor-impeller 240 can define an inner bore through which well fluid can also flow.

The electric motor 200 can include one or more radial bearings. The radial bearings can control radial levitation of the central shaft of the rotor-impeller 240 with respect to the housing 201. In the case of a magnetic radial bearing, the magnetic radial bearing can include a magnetic bearing actuator and a magnetic bearing target. The magnetic bearing actuator and the magnetic bearing target cooperate and interact magnetically to control levitation of the central shaft. The downhole-type tool 200 can include one or more magnetic bearing actuators 231 encased within the housing 201. The magnetic bearing actuators 231 can be permanent magnets (passive) or electromagnetic coils (active). In the case where the magnetic bearing actuators 231 are electromagnetic coils, they can be connected to the cable 210. The electric motor 200 can include one or more magnetic bearing targets 241 in the electric rotor-impeller 240. The magnetic bearing targets 241 can be stationary metallic poles (solid or laminated), rotating metallic poles (solid or laminated), and/or permanent magnets. The magnetic bearing targets 241 can include stationary components, for example, for conducting magnetic fields in a specific path, and rotating components. As an example, the magnetic bearing targets 241 can include a solid metallic pole that conducts a magnetic field from a stator coil (such as the one or more magnetic bearing actuators 231). The magnetic field from the stator coil (231) is radial, and the solid metallic pole of the magnetic bearing target 241 can conduct the radial magnetic field to an axial magnetic field (for a magnetic thrust bearing), at which point the magnetic field crosses a gap between a stationary pole and a rotating pole, thereby imparting a force between the stationary pole and the rotating pole.

The electric motor 200 can include one or more thrust bearings 250. The thrust bearings 250 can control axial levitation of the central shaft of the rotor-impeller 240 with respect to the housing 201. The one or more thrust bearings 250 can be magnetic thrust bearings or mechanical thrust bearings. In the case of a magnetic thrust bearing 250, the magnetic thrust bearing 250 can include permanent magnets.

After installation of the electric motor 200 in the well 100, the rotor-impeller 240 can optionally be retrieved from the well 100 while the stator 203 (and the housing 201) remain within the well 100. The housing 201 and the rotor-impeller 240 can be installed in the well 100 separately (physically and/or temporally). For example, the housing 201 (encasing the stator 203) can be installed in the well 100, and then the rotor-impeller 240 can be installed in the well 100. In some implementations, once the rotor-impeller 240 is positioned at a desired location within the well 100, the rotor-impeller 240 can be coupled to the housing 201 or a tubing of the well 100 (such as the production tubing 128 or the casing 112) by a coupling part (not shown). Then, if desired, the rotor-impeller 240 can be decoupled from the housing 201 (or the production tubing 128 or the casing 112) and be retrieved from the well 100, while the stator 203 remains in the well 100.

The housing 201 includes on its exterior a port 207 that can be in fluid communication with the well when the electric motor 200 is positioned in the well 100. The electric motor 200 includes a seal 209 that seals the port 207 against ingress of fluid into the housing 201. The seal 209 is deformable and/or movable by the well fluid, and this feature allows the seal 209 to also function as a pressure compensator for the housing 201. The seal 209 can be deformed and/or moved by the well fluid to apply a pressure on the incompressible fluid 202 to equalize pressure between the incompressible fluid 202 within the housing 201 and the well fluid. For example, the seal 209 can move and/or deform and apply pressure on the incompressible fluid 202, such that the pressures of the incompressible fluid 202 and the well fluid equalize. Well fluid flowing through the inner bore of the housing 201 at a well fluid pressure. A portion of the well fluid can flow through the port 207 to the seal 209. The seal 209 can move and/or deform under the well fluid pressure and transfer the pressure to the incompressible fluid 202 within the housing 201, thereby equalizing the pressures of the incompressible fluid 202 and the well fluid.

In some implementations, the seal 209 includes a flexible membrane. The flexible membrane can be, for example, a rubber membrane, a diaphragm, or a flexible metallic barrier and/or bellows. In implementations where the flexible membrane includes a bellows, the bellows can be fully welded, which can eliminate the risks of seal failure associated with elastomeric seals (for example, potential rupture or tear of a rubber membrane). In some implementations, the seal 209 includes a piston. The seal 209 can be disposed in a wall of the housing 201 that is orthogonal to a central axis of the tubing 128. Such implementations can have less impact on the length of the housing 201 (along the central axis) and on the placement of the seal 209 in relation to the housing 201 in comparison to implementations where the seal 209 is disposed in a circumferential wall of the housing 201. For example, in such implementations, the seal 209 can be placed in the housing 201 at a location that is less impacted by the flow of production fluid (for example, by erosion by any potential abrasive materials flowing with the production fluid). Because the fluid 202 is incompressible, minimal surface area is required for the seal 209, meaning there can be minimal spatial impact on the design of the motor 200. The seal 209 can span a circumferential portion of the housing 201 (for example, an arc of the housing 201). The electric motor 200 can include additional ports 207 and additional seals 209 sealing the respective ports 207.

The housing 201 can include a non-metallic sleeve 290 that forms at least a portion of the inner bore wall 201*a* that is continuous with the inner wall of the tubing (such as the inner wall 128*a* of the production tubing 128 or the inner wall 112*a* of the casing 112). The non-metallic sleeve 290 is configured to protect the electromagnetic coil 230 from the well fluid. The non-metallic sleeve 290 can include ceramic material, carbon fiber composite, or combinations of both. Although written here as being "non-metallic" the sleeve 290 can instead be a non-magnetic material, a material that is not magnetically conductive but electrically conductive, or a magnetically soft metallic material with high electrical resistance. Whatever material is chosen for the sleeve 290, it is desirable that the sleeve 290 minimize motor magnetic field conduction (that is, conducts rotor magnetic fields through the sleeve 290 versus through the stator 203) and minimize eddy currents. The pressure-compensating seal 209 can reduce the strength requirement of the sleeve 290 by eliminating the pressure differential between the inner diameter and the outer diameter of the sleeve 290. The pressure-compensating seal 209 therefore can allow the thickness of the sleeve 290 to be decreased in comparison to an electric motor without such a seal 209, and/or the choice of material to fabricate the sleeve 290 does not have to depend on strength/structural support. The reduction of thickness of the sleeve 290 (and material selection for the sleeve 290) can reduce the cost of materials, can reduce eddy currents, and can also allow for a larger inner bore size of the housing 201, such that other components of the electric motor 200 can be larger and occupy the increased space.

In some implementations, the seal 209 can function as a protective sleeve, and the sleeve 290 does not need to be included. In such implementations, the seal 209 can form at least a portion of the inner bore wall 201*a* that is continuous with the inner wall of the tubing (such as the inner wall 128*a* of the production tubing 128 or the inner wall 112*a* of the casing 112). The seal 209 can protect the electromagnetic coil 230 from the well fluid.

Figure 3B:
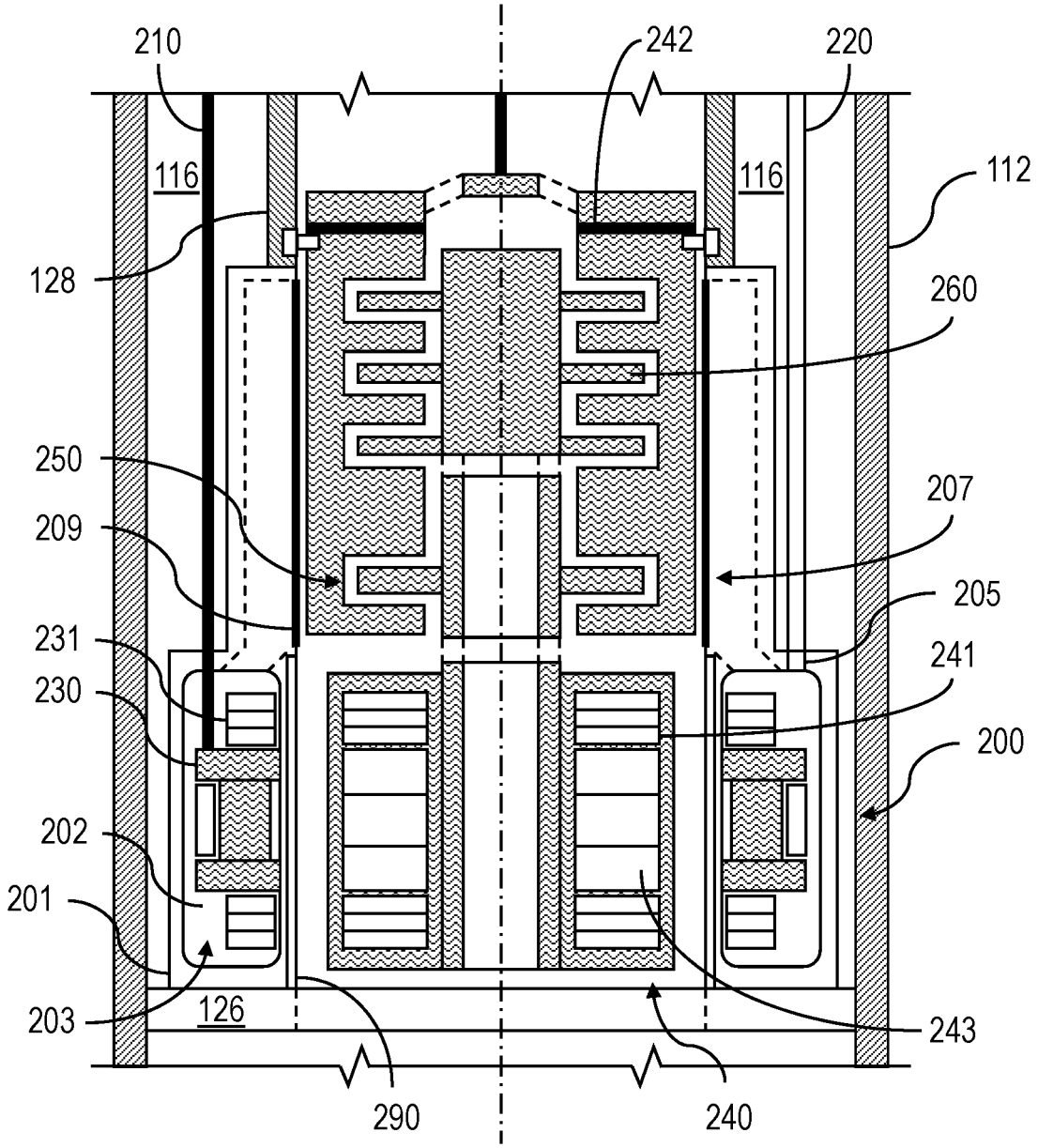

The electric motor 200 shown in FIG. 3B is substantially similar to the electric motor 200 of FIG. 3A. As shown in FIG. 3B, the seal 209 can be disposed in a circumferential wall of the housing 201 (such as the inner bore wall 201*a* of the housing 201). Implementing a larger area for the seal 209 allows for the seal 209 to deform less in comparison to a seal 209 with a smaller area because the force exerted by either the incompressible fluid 202 or the well fluid can be distributed across the larger area of the seal 209. Increasing the length of the seal 209 can enlarge the area of the seal 209. In some implementations, the length of the seal 209 along a central axis of the tubing 128 is longer than a length of the electric stator 203 along the central axis of the tubing 128. In conventional downhole-type tools (such as conventional ESPs), such seals 209 are restricted in length by the length of the tool. The electric motor 200 described in this disclosure is not restricted by the length of the stator 201 nor the length of the rotor-impeller 203. Instead, because the inner bore wall 201*a* of the housing 201 is continuous with the inner wall 128*a* of the tubing 128 (or in some implementations, with the inner wall 112*a* of the casing 112*a*), the housing 201 can extend past typical boundaries of conventional ESPs.

Although shown in FIGS. 3A and 3B as being located above the seal 209, the port 207 can optionally be located below the seal 209. Although shown in FIGS. 3A and 3B as being located above the stator 203, the port 207 and the seal 209 can optionally be located below the stator 203. In some implementations, the motor 200 includes two ports 207 and two seals 209, with one set (port 207 and seal 209) located above the stator 203, and the other set (port 207 and seal 209) located below the stator 203.

Figure 4:
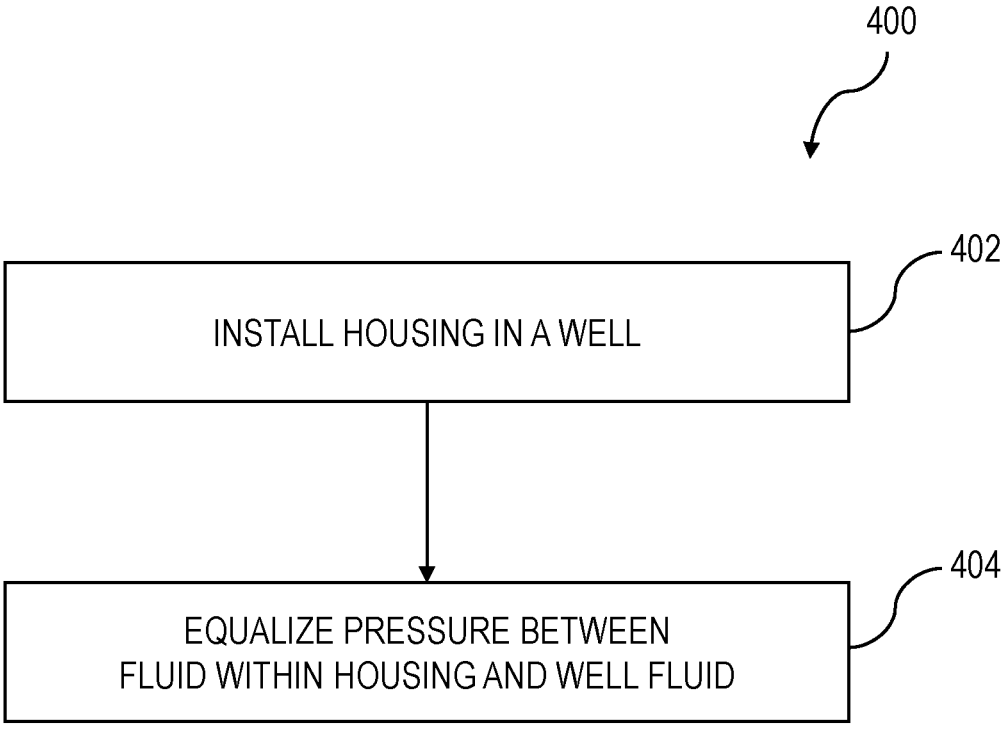
FIG. 4 is a flow chart of a method for installing any one of the downhole-type tools of FIG. 2A, 2B, 3A, or 3B.

FIG. 4 is a flow chart of a method 400 for installing the electric motor 200 in a well (such as the well 100). At step 402, a housing (such as the housing 201) is installed in the well 100. As described previously, the housing 201 is affixed to a tubing (such as the production tubing 128). The housing 201 defines an inner bore and has an inner bore wall 201*a* that is continuous with an inner wall of the tubing 128 (such as the inner wall 128*a* of the tubing 128) for flow of well fluid. In some implementations, the inner bore wall 201*a* of the housing 201 is continuous with an inner wall of the casing 112 (such as the inner wall 112*a* of the casing 112) for flow of well fluid. As described previously, the housing 201 encases an electric stator (such as the electric stator 203) and is flooded with an incompressible fluid (such as the fluid 202). The housing 201 defines on its exterior a port (such as the port 207) that, when the housing 201 is installed in the well 100, is in fluid communication with the well. The port 207 is sealed with a seal (such as the seal 209) against ingress of fluid into the housing 201. The electric stator 203 is configured to drive an electric rotor-impeller (such as the electric rotor-impeller 240).

In some implementations, where the housing 201 is affixed to the casing 112, cement is flowed into a wellbore (such as the wellbore of well 100) around the housing 201 affixed to the casing 112. The housing 201 can be sealed against ingress of cement to the electric stator 203. Cement can be flowed into an annulus between the housing 201 and a wall of the wellbore. Cement can be flowed through one or more flow paths defined in the housing 201. In some implementations, a cable (such as the cable 210) connecting the electric stator 201 to a power source at a remote location (for example, at the surface 106) is cemented in the wellbore, outside the casing 112. For example, the cable 210 can be cemented in the annulus between the casing 112 and the wellbore wall. In some implementations, the cable 210 runs through the casing 112 and is connected to the power source through the annulus 116 between the casing 112 and the production tubing 128 (examples of this configuration are shown in FIGS. 2A and 2B). Similarly, in some implementations, a cooling tube (such as the cooling tube 220) connecting an inner volume of the housing 201 to a source of coolant at a remote location (for example, at the surface 106) is cemented in the wellbore, outside the casing 112. For example, the cooling tube 220 can be cemented in the annulus between the casing 112 and the wellbore wall. In some implementations, the cooling tube 220 runs through the casing 112 and is connected to the coolant source through the annulus 116 between the casing 112 and the production tubing 128 (examples of this configuration are shown in FIGS. 2A and 2B).

At step 404, pressure is equalized by the seal 209 between the incompressible fluid 202 within the housing 201 and the well fluid. For example, in cases where the well fluid has a higher pressure than the incompressible fluid 202 within the housing 201, the well fluid can apply pressure on the seal 209. As described previously, the seal 209 can include a flexible membrane that is movable by the well fluid. The seal 209 can move and/or deform and apply pressure on the incompressible fluid 202, such that the pressures of the incompressible fluid 202 and the well fluid equalize. The seal 209 can be disposed in a wall of the housing 201 that is orthogonal to a central axis of the tubing 128 (an example shown in FIG. 3A). The seal 209 can be disposed in a circumferential wall of the housing 201 (such as the inner bore wall 201*a*, an example shown in FIG. 3B).

After the housing 201 is installed in the well 100, the electric rotor-impeller 240 can be positioned within the inner bore 201*a* of the housing 201. Power can then be provided to the electric stator 203, for example, through the cable 210 in order to drive the electric rotor-impeller 240. In some cases, it may be desirable to retrieve the electric rotor-impeller 240 (for example, to perform maintenance). The electric rotor-impeller 240 can be retrieved from the wellbore while the stator 203 remains within the wellbore. For example, the electric rotor-impeller 240 can be retrieved from the well 100 using a slickline.

Figure 5:
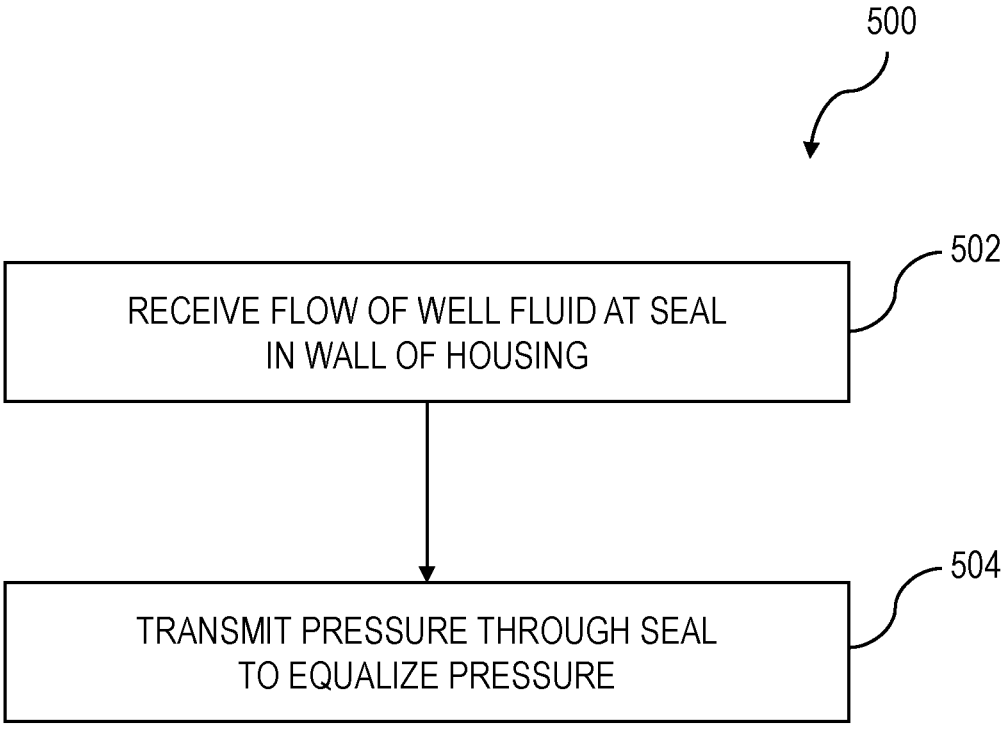
FIG. 5 is a flow chart of a method for using any one of the downhole-type tools of FIG. 2A, 2B, 3A, or 3B.

FIG. 5 is a flow chart of a method 500 for using the electric motor 200. At step 502, a flow of well fluid is received at a seal (such as the seal 209) in a wall of a housing (such as the inner bore wall 201*a* of the housing 201). As described previously, the housing 201 encases an electric stator (such as the electric stator 203) and is flooded with an incompressible fluid (such as the fluid 202). The housing 201 is affixed to a tubing (such as the production tubing 128). The housing 201 has an inner, circumferential wall (such as the inner bore wall 201*a*) that is continuous with an inner, circumferential wall of the tubing 128 (such as the inner wall 128*a* of the tubing 128) for flow of well fluid. In some implementations, the inner, circumferential wall 201*a* of the housing 201 is continuous with an inner, circumferential wall of the casing 112 (such as the inner wall 112*a* of the casing 112) for flow of well fluid. The seal 209 prevents ingress of the well fluid into the incompressible fluid 202 within the housing 201.

In response to receiving the flow of well fluid at step 502, pressure is transmitted through the seal 209 to equalize pressure between the incompressible fluid 202 and the well fluid at step 504. As described previously, the seal 209 can include a flexible membrane that is movable by the well fluid. The seal 209 can move and/or deform and apply pressure on the incompressible fluid 202, such that the pressures of the incompressible fluid 202 and the well fluid equalize. The seal 209 can be disposed in a wall of the housing 201 that is orthogonal to a central axis of the tubing 128 (an example shown in FIG. 3A). The seal 209 can be disposed in a circumferential wall of the housing 201 (such as the inner bore wall 201*a*, an example shown in FIG. 3B).

The electric stator 203 can be connected to and receive power from a power source that is in a remote location (for example, at the surface 106) through a cable (such as the cable 210). In response to receiving power, the electric stator 203 can drive an electric rotor-impeller (for example, the electric rotor-impeller 240). As described previously, rotation of the electric rotor-impeller 240 can induce well fluid flow by creating a pressure differential within the well 100.

In this disclosure, "approximately" means a deviation or allowance of up to 10 percent (%) and any variation from a mentioned value is within the tolerance limits of any machinery used to manufacture the part. Values expressed in a range format should be interpreted in a flexible manner to include not only the numerical values explicitly recited as the limits of the range, but also to include all the individual numerical values or sub-ranges encompassed within that range as if each numerical value and sub-range is explicitly recited. For example, a range of "0.1% to about 5%" or "0.1% to 5%" should be interpreted to include about 0.1% to about 5%, as well as the individual values (for example, 1%, 2%, 3%, and 4%) and the sub-ranges (for example, 0.1% to 0.5%, 1.1% to 2.2%, 3.3% to 4.4%) within the indicated range. The statement "X to Y" has the same meaning as "about X to about Y," unless indicated otherwise. Likewise, the statement "X, Y, or Z" has the same meaning as "about X, about Y, or about Z," unless indicated otherwise. "About" can allow for a degree of variability in a value or range, for example, within 10%, within 5%, or within 1% of a stated value or of a stated limit of a range.

While this disclosure contains many specific implementation details, these should not be construed as limitations on the subject matter or on what may be claimed, but rather as descriptions of features that may be specific to particular implementations. Certain features that are described in this disclosure in the context of separate implementations can also be implemented, in combination, in a single implementation. Conversely, various features that are described in the context of a single implementation can also be implemented in multiple implementations, separately, or in any suitable sub-combination. Moreover, although previously described features may be described as acting in certain combinations and even initially claimed as such, one or more features from a claimed combination can, in some cases, be excised from the combination, and the claimed combination may be directed to a sub-combination or variation of a sub-combination.

Particular implementations of the subject matter have been described. Nevertheless, it will be understood that various modifications, substitutions, and alterations may be made. While operations are depicted in the drawings or claims in a particular order, this should not be understood as requiring that such operations be performed in the particular order shown or in sequential order, or that all illustrated operations be performed (some operations may be considered optional), to achieve desirable results. Accordingly, the previously described example implementations do not define or constrain this disclosure.

What is claimed is:

1. An electric motor configured to be positioned in a well, comprising:

a housing flooded with an incompressible fluid, the housing configured to affix to a tubing of the well, the housing defining an inner bore having an inner bore wall continuous with an inner wall of the tubing for flow of well fluid, the housing defining on an exterior of the housing a port that, when the electric motor is positioned in the well, is in fluid communication with the well;

a seal sealing the port against ingress of fluid into the housing, wherein the seal is movable by the well fluid to apply a pressure on the incompressible fluid to equalize pressure between the incompressible fluid and the well fluid;

an electric stator encased in the housing; and an electric rotor-impeller configured to be positioned within the inner bore of the housing, the electric rotor-impeller configured to be driven by the electric stator, and the electric rotor-impeller configured to be retrievable from the well while the electric stator remains in the well.

2. The electric motor of claim 1, wherein the seal comprises a flexible membrane.

3. The electric motor of claim 2, wherein the electric stator comprises an electromagnetic coil for driving rotation of the electric rotor-impeller.

4. The electric motor of claim 3, wherein the seal is non-metallic and forms at least a portion of the inner bore wall continuous with the inner wall of the tubing, and the seal is configured to protect the electromagnetic coil from the well fluid.

5. The electric motor of claim 3, wherein the housing comprises a non-metallic sleeve forming at least a portion of the inner bore wall continuous with the inner wall of the tubing, the non-metallic sleeve configured to protect the electromagnetic coil from the well fluid.

6. The electric motor of claim 5, wherein the non-metallic sleeve comprises at least one of ceramic material or carbon fiber composite.

7. The electric motor of claim 2, wherein a length of the seal along a central axis of the tubing is longer than a length of the electric stator along the central axis of the tubing.

8. The electric motor of claim 2, wherein the seal is disposed in the inner bore wall of the housing.

9. The electric motor of claim 2, wherein the seal is disposed in a wall of the housing that is orthogonal to a central axis of the tubing.

10. A method, comprising:

installing in a well, a housing affixed to a tubing, the housing defining an inner bore and having an inner bore wall that is continuous with an inner wall of the tubing for flow of well fluid, the housing encasing an electric stator and flooded with an incompressible fluid, the housing defining on an exterior of the housing a port that, when the housing is installed in the well, is in fluid communication with the well, and the port sealed with a seal against ingress of fluid into the housing; and by the seal, equalizing pressure between the incompressible fluid within the housing and the well fluid.

11. The method of claim 10, further comprising:

after installing the housing within the well, positioning an electric rotor-impeller within the inner bore of the housing; and providing power to the electric stator to drive the electric rotor-impeller.

12. The method of claim 11, further comprising retrieving the electric rotor-impeller from the well while the electric stator remains within the well.

13. The method of claim 11, wherein the seal comprises a flexible membrane that is movable by the well fluid to apply a pressure on the incompressible fluid within the housing to equalize pressure between the incompressible fluid and the well fluid.

14. The method of claim 13, wherein the seal is disposed in the inner bore wall of the housing.

15. The method of claim 13, wherein the seal is disposed in a wall of the housing that is orthogonal to a central axis of the tubing.

16. A method, comprising:

receiving a flow of well fluid at a seal disposed in a wall of a housing, the housing encasing an electric stator and flooded with an incompressible fluid, the housing affixed to a tubing of a well, wherein an inner, circumferential wall of the housing is continuous with an inner, circumferential wall of the tubing, and the seal prevents ingress of the well fluid into the incompressible fluid within the housing, wherein the seal comprises a flexible membrane, and the housing comprises a non-metallic sleeve forming at least a portion of the inner, circumferential wall of the housing continuous with the inner wall of the tubing;

isolating, with the non-metallic sleeve, the electric stator from the flow of well fluid; and in response to receiving the flow of well fluid, transmitting pressure through the seal to equalize pressure between the incompressible fluid and the well fluid.

17. The method of claim 16, wherein the seal is disposed in the inner, circumferential wall of the housing.

18. The method of claim 16, wherein the seal is disposed in a wall of the housing that is orthogonal to a central axis of the tubing.

19. The method of claim 16, comprising:

receiving, with the electric stator, power from a remote location; and driving, with the electric stator, an electric rotor-impeller in response to receiving power.

* * * * *